US007102093B1

(12) United States Patent
Chiu

(10) Patent No.: US 7,102,093 B1
(45) Date of Patent: Sep. 5, 2006

(54) KEY WITH BINDING STRUCTURE

(75) Inventor: Chin-Te Chiu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/220,441

(22) Filed: Sep. 7, 2005

(51) Int. Cl.
*H01H 13/14* (2006.01)
*H01H 3/12* (2006.01)

(52) U.S. Cl. ..... 200/341; 200/512; 200/520

(58) Field of Classification Search ..... 200/341, 200/512, 520, 513–515, 329, 5 A
See application file for complete search history.

(56) References Cited

U.S. PATENT DOCUMENTS 5,340,956 A * 8/1994 Chen ..... 200/341
5,573,107 A * 11/1996 Nakano et al. ..... 200/314
5,718,326 A * 2/1998 Larose et al. ..... 200/314
5,729,222 A * 3/1998 Iggulden et al. ..... 341/31
5,777,281 A * 7/1998 Riddiford ..... 200/5 A
5,791,459 A * 8/1998 Hester et al. ..... 200/512
6,201,468 B1 * 3/2001 DeVolpi ..... 338/47
6,388,218 B1 * 5/2002 Ando et al. ..... 200/512

* cited by examiner

*Primary Examiner*—Kyung Lee

(57) ABSTRACT

A key with binding structure includes an elastic key body and a membrane board bound to each other by an adhesive. The elastic key body has an operation portion extending upward there-from for being accessible and a supporting portion protruding downward there-from. A loop groove is defined in a bottom surface of the supporting portion. The membrane board has a top surface from which a projecting wall is projected. The projecting wall is wedged into the loop groove. In assembling, the loop groove absorbs the superfluous adhesive, thereby preventing the adhesive from overflowing. The engagement between the projecting wall and the loop groove performs positioning of the elastic key body and a membrane board, so a fixture for location is not needed in assembling.

3 Claims, 6 Drawing Sheets

KEY WITH BINDING STRUCTURE

BACKGROUND OF THE INVENTION

1. Field of the Invention

The present invention relates generally to a key, and more particularly, to a binding structure of the key.

2. The Related Art

At present, Keypads are widespread and used in various electronic devices, such as mobile phones, computers, PDAS (Personal Digital Assistants), etc.

A traditional keypad includes an elastic keyboard, a membrane board and a printed circuit board. The membrane board is fixed to a top surface of the printed circuit board. The membrane board and the printed circuit board together compose a plurality of dome switches. A plurality of key bodies is formed on the elastic keyboard. Each elastic key body has an upper portion projecting upward for being pressed thereon and a lower portion projecting downward for connecting the membrane board to control the switches in response to pressure operation on the upper portion. The connection between the key bodies and the membrane board is achieved by adhesive spread between the elastic keyboard and the membrane board.

However, during binding the elastic keyboard and the membrane board with adhesive, it is difficult to control the amount of the adhesive, and the adhesive always overflows. This takes negative effect on the quality of the keypad.

It is another disadvantage of the traditional keypad that a fixture is required to position the elastic keyboard or the membrane board in the process of binding the elastic keyboard to the membrane board. If not, the elastic keyboard and the membrane board may not be aligned. Accordingly, since the fixture is inevitable in assembling, the assembling work is time-consuming, and the manufacturing cost is increased.

SUMMARY OF THE INVENTION

According to an aspect of the present invention, there is provided a key with binding structure comprising an elastic key body and a membrane board disposed under the elastic key body. The elastic key body has an operation portion extending upward there-from for being accessible and a supporting portion protruding downward there-from. The supporting portion has a bottom surface in which a loop groove is defined. The membrane board has a top surface. The elastic key body is bound with the membrane board by an adhesive disposed between the bottom surface of the elastic key body and the top surface of the membrane board. In assembling, the loop groove absorbs the superfluous adhesive. This prevents the adhesive from overflowing.

According to another aspect of the present invention, there is provided a binding structure of a key having an elastic key body and a membrane board adhering each other by an adhesive between a bottom surface of the elastic key body and a top surface of the membrane board. The binding structure includes a loop groove defined in the bottom surface of the elastic key body and a projecting wall projected from the top surface of the membrane board. The loop groove absorbs the superfluous adhesive, thereby preventing the adhesive from overflowing. The projecting wall is wedged into the loop groove. The engagement between the projecting wall and the loop groove performs positioning of the elastic key body and a membrane board, so a fixture for location is not needed in assembling. Thus, the assembling process is simple and further to cut down the manufacturing cost.

The above-mentioned and other features and objects of this invention and the manners of attaining them will become more apparent and the invention itself will be better understood by reference to the following description of preferred embodiments of the invention taken in conjunction with the accompanying figures, wherein:

DETAILED DESCRIPTION OF THE PREFERRED EMBODIMENTS

Figure 1:
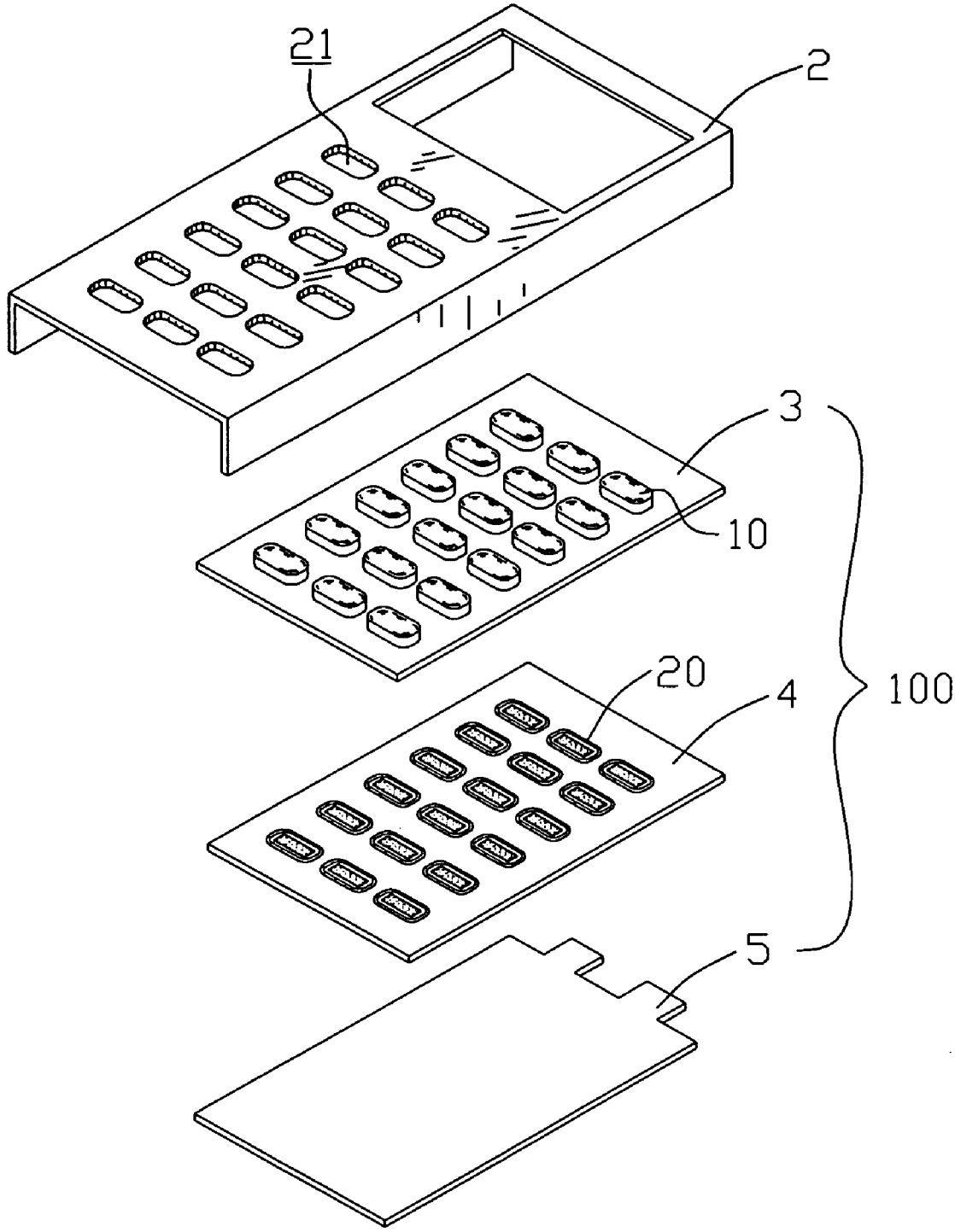
FIG. 1 is an exploded perspective view of a keypad including a key with binding structure according to the present invention.

While the present invention is susceptible of embodiments in various forms, as shown in the drawings, hereinafter will be described the presently preferred embodiments of the invention with the understanding that the present disclosures are to be considered as exemplifications of the invention, and are not intended to limit the invention to specific embodiments illustrated.

FIG. 1 shows an exploded view of a keypad 100 adapted to be used in an electronic device, such as a computer, a phone, a PDA (Personal Digital Assistant) etc, which has an outer housing 2 with a plurality of holes 21 defined therein. The keypad 100 comprises an elastic keyboard 3, a membrane plate 4 and a printed circuit board 5. In assembling, the elastic keyboard 3 is bound to the membrane board 4. The elastic keyboard 3 has a plurality of elastic key bodies 10 extending upward there-from so as to project through the holes 21 of the outer housing 2 for being accessible, that is, for being pressed thereon by users. The elastic keyboard 3 and the membrane plate 4 compose a plurality of keys 1, one of which is illustrated in FIG. 2.

Figure 2:
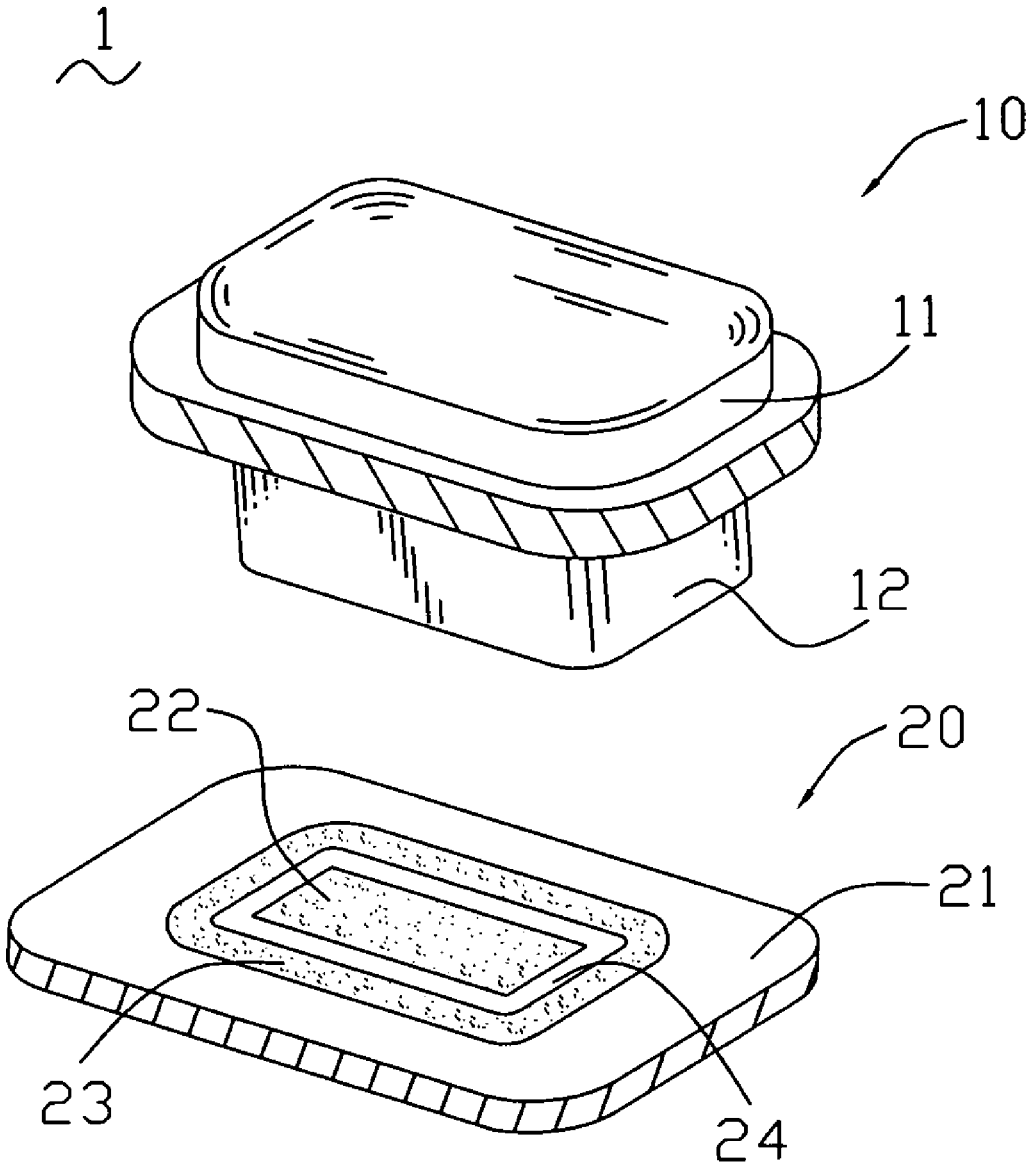
FIG. 2 is an exploded perspective view of a key with binding structure of a first embodiment according to the present invention.
Figure 3:
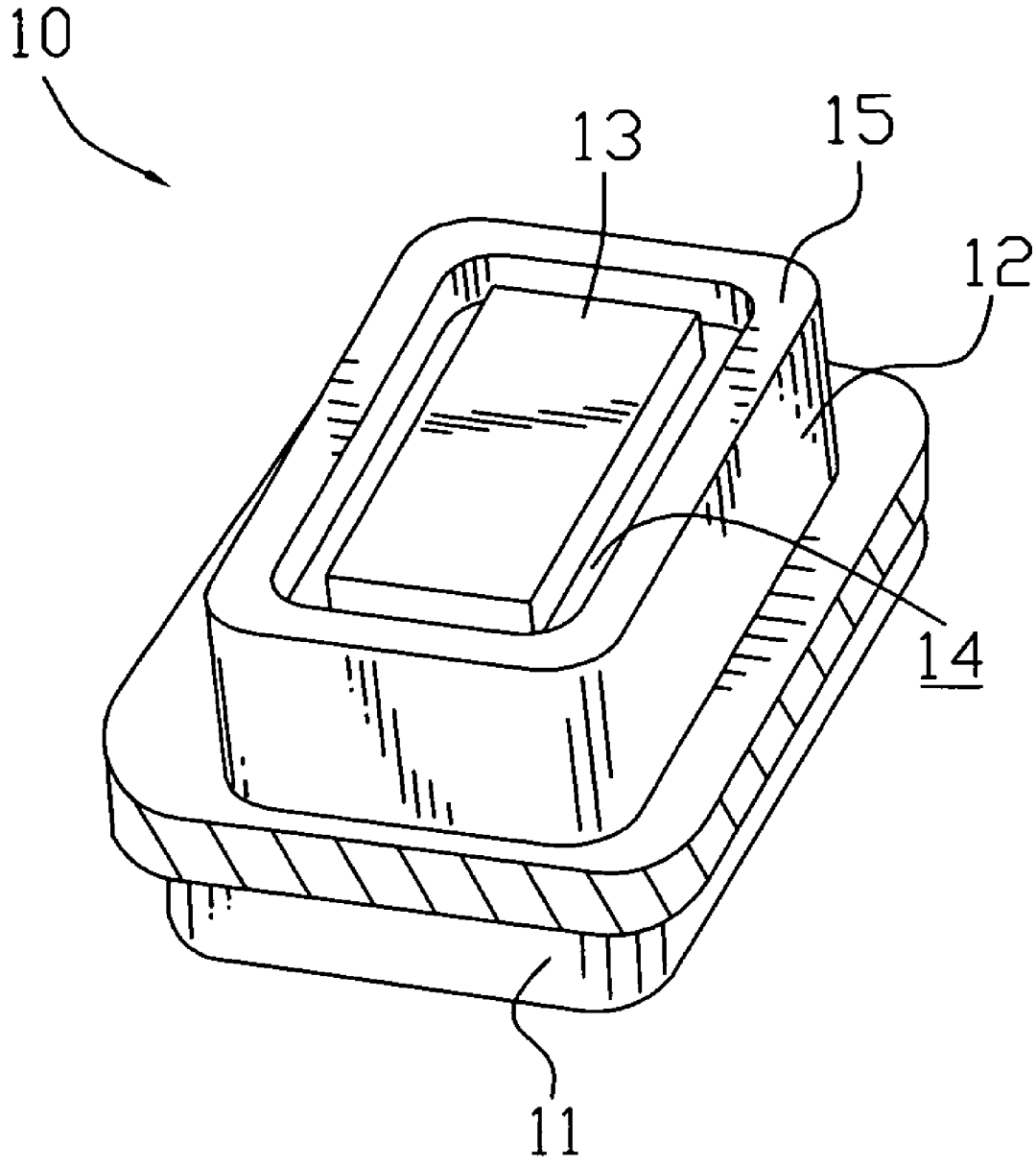
FIG. 3 is a perspective view of an elastic key body of the key shown in FIG. 2.

Referring to FIG. 2 and FIG. 3, the key with binding structure 1 is shown. In order to describe concisely and clearly, other structures of the keypad are omitted in FIG. 2, and the condition is the same to the following figures. The key with binding structure 1 comprises an elastic key body 10 and a membrane board 20 disposed under the elastic key body 10. The elastic key body 10 has an operation portion 11 upward for being accessible and a supporting portion 12 protruded downward. The supporting portion 12 has a bottom surface in which a rectangular loop groove 14 is defined. Thus, the rectangular loop groove 14 divides the supporting portion 13 into a rectangular platform 13 and an annular wall 15. The rectangular platform 13 is located at the center of the supporting portion 12 and the annular wall 15 is located around an outer periphery of the supporting portion 12. That is to say, the loop groove 14 is defined between the rectangular platform 13 and the annular wall 15. The membrane board 20 has a base body 21. A top surface of the base body 21 has a rectangular binding region 22 and an annular binding region 23. The rectangular binding region 22 is located at a center of the base body 21, and the annular binding region 23 is located around the rectangular binding region 22. A banding region 24 is formed between the rectangular binding region 22 and the annular binding region 23.

Figure 4:
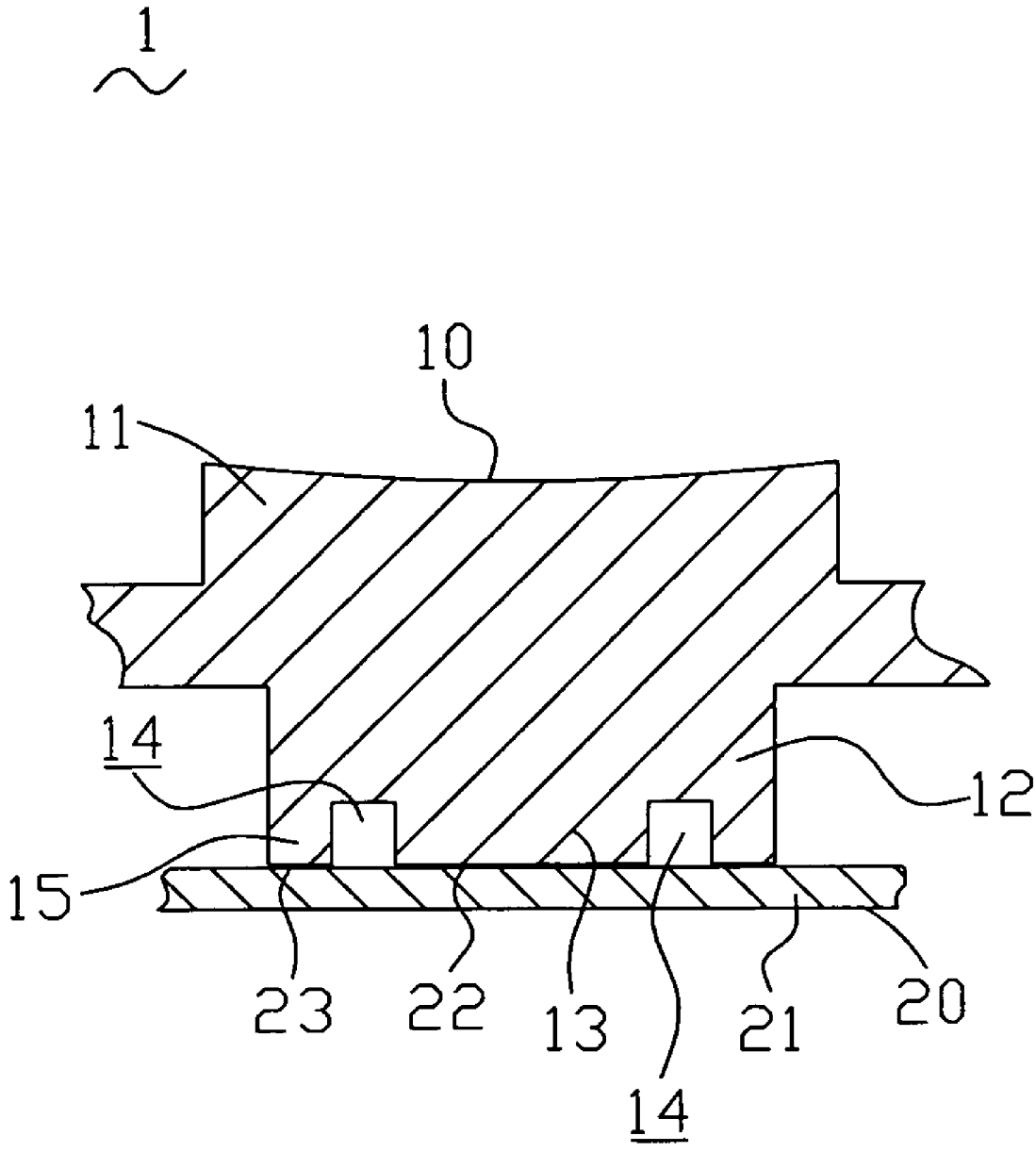
FIG. 4 is a cross-sectional view of the key shown in FIG. 2.

Referring to FIG. 4, in assembling, the elastic key body 10 is disposed under the membrane board 20, and adhesives are ejected on top surfaces of the rectangular platform 13 and the annular wall 15, and then the membrane board 20 is pressed onto the elastic key body 10. The rectangular platform 13 is bound with the rectangular binding region 22 and the annular wall 15 is securely bound with the annular binding region 23 of the membrane board 20. Compared to the prior art, since the loop groove 14 is defined between the rectangular platform 13 and the annular wall 15, the amount of adhesive is easily controlled to be ejected onto both surfaces of the platform 13 and the annular wall 15. During the process of binding, the loop groove 14 absorbs superfluous adhesives, and the phenomenon of adhesive overflow is avoided. After assembling, the elastic key body 10 and the membrane board 20 are easy to be fabricated with other structures of the keypad 100.

Figure 5:
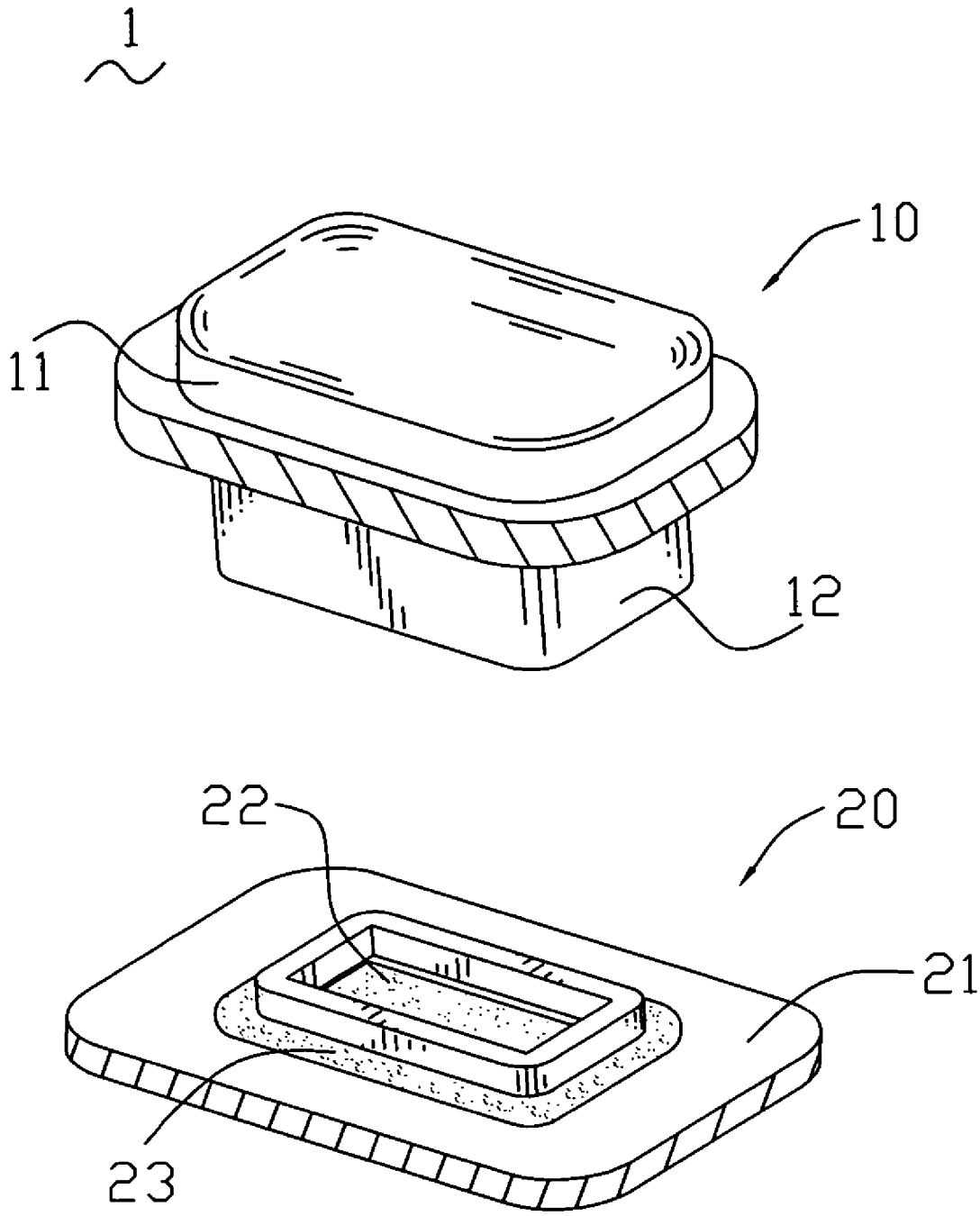
FIG. 5 is an exploded perspective view of a key with binding structure of a second embodiment according to the present invention.
Figure 6:
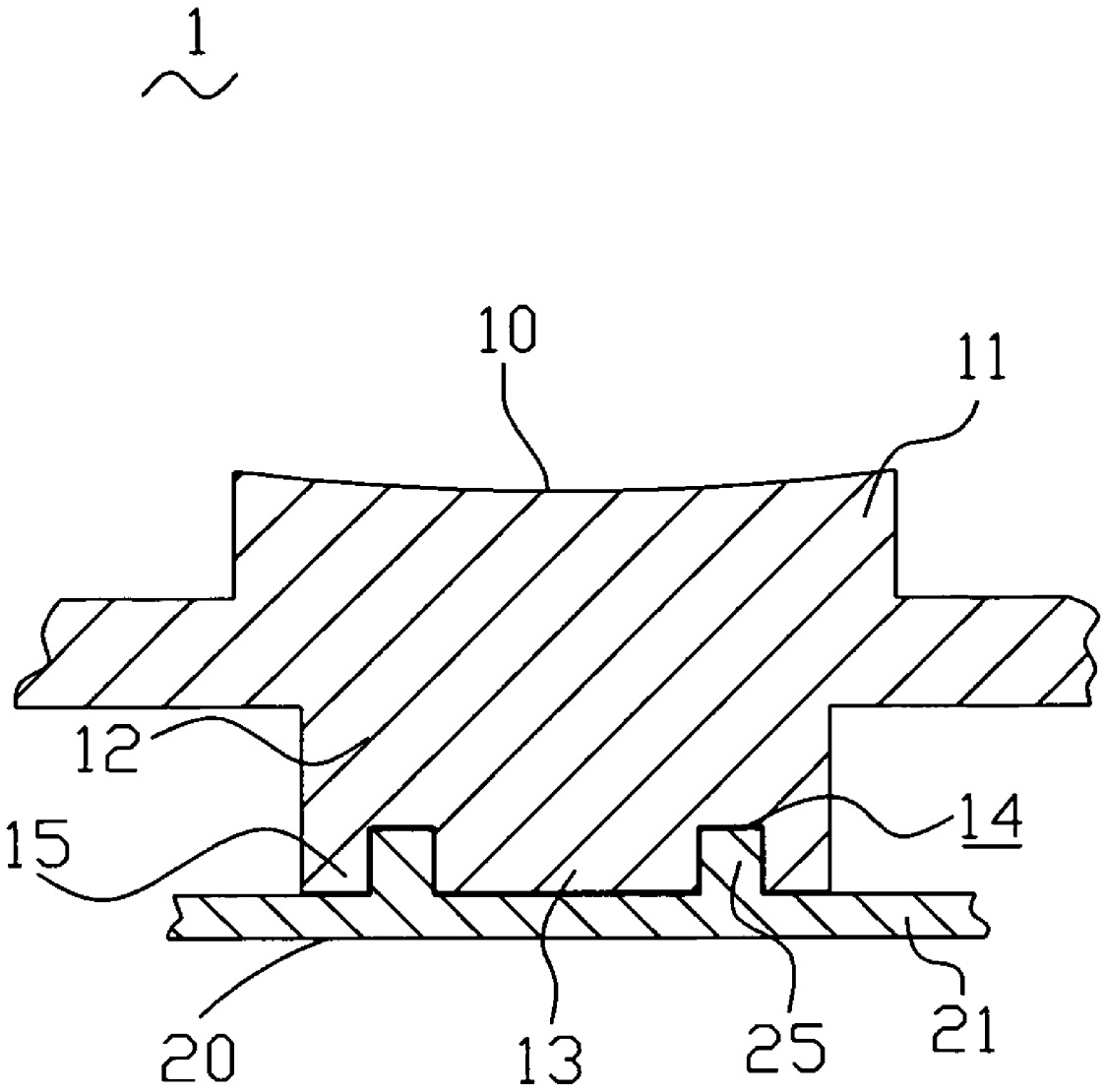
FIG. 6 is a cross-sectional view of the key shown in FIG. 5.

Referring to FIG. 5 and FIG. 6, which show a second embodiment of the present invention, the difference between the two embodiments is that the banding region 24 of the membrane board 20 in the first embodiment is protruded to form a projecting wall 25 in the second embodiment. Adhesives are ejected onto top surface of the annular binding region 23, the rectangular region 22 and the projecting wall 25 of the membrane board 20, so the loop groove 14 and the rectangular platform 13 are respectively bound with the projecting wall 25 and the rectangular binding region 22 of the membrane board 20. The annular wall 15 is bound with the annular binding region 23. The projecting wall 25 is wedged into the loop groove 14 to be conveniently located therein thus to eliminate a fixture for locating the elastic key body 10 to the membrane board 20.

According to the present invention, during the process of assembling, the superfluous adhesive is absorbed by the loop groove 14 so as to avoid a phenomenon of adhesive overflowing. Additionally, the projecting wall 25 is wedged into the annular groove 14 for locating the elastic key body 10 to the membrane board 20 so as to eliminate a fixture for location, and the manufacturing cost is cut down.

The present invention provides for an inexpensive and simple way to manufacture a key with binding structure. While several particular forms of the invention have been illustrated and described, it will be apparent that various modifications can be made without departing from the spirit and scope of the invention. Accordingly, it is intended that this invention be limited only by the scope of the appended claims.

What is claimed is:

1. A key with binding structure comprising:

an elastic key body having an operation portion extending upward there-from for being accessible and a supporting portion protruding downward there-from, said supporting portion having a bottom surface in which a loop groove is defined, said loop groove dividing said supporting portion into a rectangular platform at a center thereof and an annular wall there-around; and a membrane board disposed under said elastic key body, said membrane board having a top surface;

wherein said elastic key body is bound with said membrane board by an adhesive disposed between the bottom surface of the elastic key body and the top surface of the membrane board, and said loop groove absorbs a superfluous portion of said adhesive to avoid.

2. The key with binding structure as claimed in claim 1, wherein said top surface of said membrane board has a rectangular binding region for binding to said rectangular platform and an annular binding region around said rectangular binding region for binding to said annular wall.

3. The key with binding structure as claimed in claim 2, wherein a projecting wall is formed between said rectangular binding region and said annular binding region, and said projecting wall is wedged into said loop groove.

* * * * *